US008658018B2

(12) United States Patent
Rosenbaum et al.

(10) Patent No.: US 8,658,018 B2
(45) **Date of Patent: *Feb. 25, 2014**

(54) LUBRICANT BASE OIL BLEND HAVING LOW WT% NOACK VOLATILITY

(75) Inventors: John M. Rosenbaum, Richmond, CA (US); Nancy J. Bertrand, Lafayette, CA (US); Scott C. Deskin, Alameda, CA (US); Brent K. Lok, San Francisco, CA (US); Shuibo Xie, Berkeley, CA (US); Stephen J. Miller, San Francisco, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 1064 days.

This patent is subject to a terminal disclaimer.

(21) Appl. No.: 11/613,883

(22) Filed: Dec. 20, 2006

(65) Prior Publication Data

US 2008/0149529 A1 Jun. 26, 2008

(51) Int. Cl.
*C10G 71/00* (2006.01)
*C10M 111/00* (2006.01)
*C07C 5/13* (2006.01)

(52) U.S. Cl.
USPC ..... 208/18; 208/19; 208/24; 208/28; 508/110; 585/240; 585/253

(58) Field of Classification Search
USPC ..... 508/466, 468, 469, 585, 591; 208/18, 208/19, 950, 27, 97
See application file for complete search history.

(56) References Cited

U.S. PATENT DOCUMENTS

| | | | | |
|---|---|---|---|---|
| 7,083,713 | B2 | 8/2006 | Abernathy et al. | |
| 2004/0094453 | A1* | 5/2004 | Lok et al. | 208/19 |
| 2004/0178118 | A1* | 9/2004 | Rosenbaum et al. | 208/18 |
| 2005/0133407 | A1 | 6/2005 | Abernathy et al. | |
| 2005/0133409 | A1* | 6/2005 | Abernathy et al. | 208/27 |
| 2005/0261145 | A1* | 11/2005 | Rosenbaum et al. | 508/466 |
| 2005/0261146 | A1 | 11/2005 | Rosenbaum et al. | |
| 2005/0261147 | A1 | 11/2005 | Rosenbaum et al. | |
| 2006/0201851 | A1 | 9/2006 | Rosenbaum et al. | |
| 2006/0201852 | A1 | 9/2006 | Rosenbaum et al. | |
| 2006/0205610 | A1 | 9/2006 | Rosenbaum et al. | |

FOREIGN PATENT DOCUMENTS

| | | | |
|---|---|---|---|
| EP | 1238045 | A1 | 5/2001 |
| WO | WO2004/053034 | A1 | 6/2004 |

* cited by examiner

*Primary Examiner* — Ellen McAvoy
*Assistant Examiner* — Latosha Hines
(74) *Attorney, Agent, or Firm* — Jeffrey M. McQuiston; Susan M. Abernathy

(57) ABSTRACT

A lubricant base oil blend having a wt % Noack volatility less than 29, comprising a) a light base oil fraction having a kinematic viscosity at 100° C. between 1.5 and 3.6, and a wt % Noack volatility both between 0 and 100 and less than a Noack Volatility Factor, and b) a petroleum-derived base oil fraction. A process to make the lubricant base oil blend having a wt % Noack volatility less than 29. Also, a pour point depressed lubricant base oil blend having a Brookfield viscosity at −40° C. of less than 18,000 cP, comprising the light base oil fraction, a petroleum-derived base oil fraction, and a pour point depressant.

47 Claims, 1 Drawing Sheet

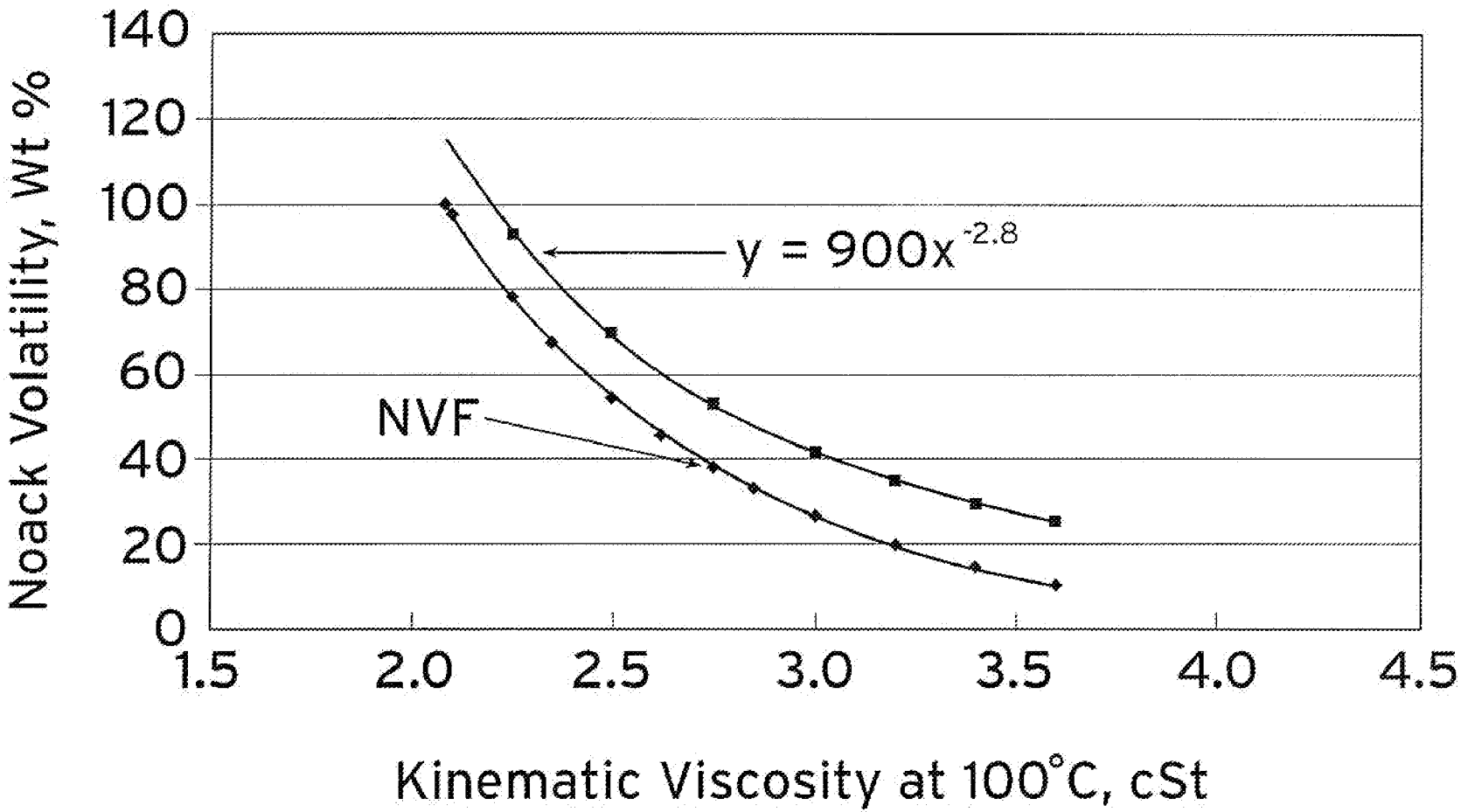
Noack Volatility, Wt %
140
120
100
80
60
40
20
0
1.5
2.0
2.5
3.0
3.5
4.0
4.5
Kinematic Viscosity at 100°C, cSt
y = 900x^-2.8
NVF

LUBRICANT BASE OIL BLEND HAVING LOW WT% NOACK VOLATILITY

FIELD OF THE INVENTION

This invention is directed to a composition and process to make a lubricant base oil blend having a low wt % Noack volatility and a composition of a pour point depressed lubricant base oil blend having a low Brookfield viscosity.

BACKGROUND OF THE INVENTION

Group I base oils, especially in Europe, have evolved to meet automotive standards for viscosity index and volatility by more severe solvent extraction and by narrow-cut distillation. While this meets volatility targets and slightly improves viscometrics for blending engine oils, it is an inefficient approach to the problem. Examples of the current Group I base oils that meet automotive standards are Esso150SN and Esso145SN in Europe and ExxonMobil 150SN in North America.

Light Fischer-Tropsch derived base oils and blends of these light base oils are known, but none of the prior art base oils or blends have the desired low wt % Noack volatility of this invention.

What is desired are light base oil fractions having improved wt % Noack volatility that are useful in lubricant base oil blends and finished lubricants. What is also desired is a base oil blend, utilizing light base oil fractions having a wt % Noack volatility less than a Noack Volatility Factor, that is equivalent or better in terms of viscometrics and volatility to current Group I base oils that meet automotive standards. High quality light base oil fractions, made from waxy feeds, having a Noack volatility less than a Noack Volatility Factor, can now be made available in large quantities and at low cost, making them desired components to include in automotive engine oils and other finished lubricant applications.

SUMMARY OF THE INVENTION

We have invented a process for making a lubricant base oil blend, comprising blending together:

a. a light base oil fraction having:
   i. a kinematic viscosity at 100° C. between 1.5 and 3.6 cSt and
   ii. a wt % Noack volatility between 0 and 100 and additionally less than a Noack Volatility Factor, wherein the Noack Volatility Factor is defined by the equation: 900×(Kinematic Viscosity at 100° C.)$^{-2.8}$−15; with b. a heavier base oil fraction comprising a petroleum-derived base oil;

wherein the lubricant base oil blend has a wt % Noack volatility less than or equal to 29.

We have also invented a lubricant base oil blend, comprising;

a. a light base oil fraction characterized by a kinematic viscosity of about 1.5 to 3.6 cSt at 100 degrees C. and a wt % Noack volatility between 0 and 100 and additionally less than a Noack Volatility Factor, wherein the Noack Volatility Factor is defined by the equation: 900×(Kinematic Viscosity at 100° C.)$^{-2.8}$−15; and b. a petroleum-derived base oil fraction;

wherein the lubricant base oil blend has a wt % Noack volatility less than or equal to 29.

We have also invented a pour point depressed lubricant base oil blend having a Brookfield viscosity at −40° C. of less than 18,000 cP, comprising:

a. a light base oil fraction characterized by a kinematic viscosity of about 1.5 to 3.6 cSt at 100 degrees C. and a wt % Noack volatility between 0 and 100 and additionally less than a Noack Volatility Factor, wherein the Noack Volatility Factor is defined by the equation: 900×(Kinematic Viscosity at 100° C.)$^{-2.8}$−15;

b. a petroleum-derived base oil fraction; and c. a pour point depressant.

BRIEF DESCRIPTION OF THE DRAWINGS

FIG. 1 illustrates the plots of two lines. One line is defined by the equation of y=900×(Kinematic Viscosity at 100° C., in cSt)$^{-2.8}$ and the second line is defined by the equation y=900×(Kinematic Viscosity at 100° C., in cSt)$^{-2.8}$−15, The second line represents the upper limit of the wt % Noack volatility, or the Noack Volatility Factor (NVF), associated with the lubricants, light base oil fractions, and the lubricant base oil blends of the present invention.

DETAILED DESCRIPTION OF THE INVENTION

This invention provides for the first time a light base oil fraction having a low wt % Noack volatility, such that the light base oil fraction has a wt % Noack volatility less than the Noack Volatility Factor (NVF) of the light base oil fraction and additionally between 0 and 100.

Noack Volatility Factor:

The Noack Volatility Factor of an oil is defined by the equation:

$$\text{Noack Volatility Factor}=900\times(\text{Kinematic Viscosity at } 100^\circ\text{ C., in cSt})^{-2.8}-15.$$

The Kinematic Viscosity at 100° C. is the value measured on the oil by ASTM D445-08. We have discovered that light base oil fractions that have a wt % Noack volatility less than their Noack Volatility Factor are especially useful to use in lubricant base oil blends. The resulting lubricant base oil blends may be API Group I or API Group II base oils, however they have surprisingly good wt % Noack volatility and low temperature properties. Wt % Noack volatility is measured by ASTM D5800-05 Procedure B, of an equivalent test method. Where an equivalent test method is used, this is indicated.

The specifications for Lubricating Base Oils are defined in the API Interchange Guidelines (API Publication 1509).

| API Group | Sulfur, ppm | | Saturates, % | VI |
|---|---|---|---|---|
| I | >300 | And/or | <90 | 80-120 |
| II | ≤300 | And | ≥90 | 80-120 |
| III | ≤300 | And | ≥90 | >120 |
| IV | All Polyalphaolefins (PAOs) | | | |
| V | All Base Oils Not Included in API Groups I-IV | | | |

API Group I base oils are desired in certain finished lubricant formulations as there are specialized additive packages and individual additives that are designed for use in these base oils.

Light Base Oil Fraction

The Sight base oil fraction of this invention has a kinematic viscosity at 100° C. between 1.5 and 3.6 cSt. Kinematic viscosity is measured by ASTM D445-06. The light base oil fraction has a wt % Noack volatility between 0 and 100 and additionally less than its Noack Volatility Factor (NVF).

In one embodiment, the light base oil fraction of this invention is blended with a heavier base oil fraction. The heavier base oil fraction may comprise a petroleum-derived API Group I or Group II base oil. Petroleum-derived API Group I base oils are commercially available in large quantities at relatively low cost compared to other base oils.

The viscosity index of the light base oil fraction of this invention will be high. It will generally have a viscosity index greater than 28×Ln(Kinematic Viscosity at 100° C.)+80. In some embodiments, it will have a viscosity index greater than 28×Ln(Kinematic Viscosity at 100° C.)+95. The test method used to measure viscosity index is ASTM D 2270-04.

The light base oil fraction has a weight percent olefins less than about 10, preferably less than about 5, more preferably less than about 1, even more preferably less than about 0.5, and most preferably less than 0.05 or 0.01. The light base oil fraction preferably has a weight percent aromatics less than about 0.1, more preferably less than about 0.05, and most preferably less than about 0.02.

In some embodiments, where the olefin and aromatics contents are significantly low in the light base oil fraction of the lubricating oil, the Oxidator BN of the selected light base oil fraction will be greater than about 25 hours, preferably greater than about 35 hours, more preferably greater than about 40 or even 49 hours. The Oxidator BN of the light base oil fraction will typically be less than about 75 hours. Oxidator BN is a convenient way to measure the oxidation stability of base oils. The Oxidator BN test is described by Stangeland et al. in U.S. Pat. No. 3,852,207. The Oxidator BN test measures the resistance to oxidation by means of a Dornte-type oxygen absorption apparatus. See R. W. Dornte "Oxidation of White Oils," Industrial and Engineering Chemistry, Vol. 28, page 26, 1936. Normally, the conditions are one atmosphere of pure oxygen at 340° F. The results are reported in hours to absorb 1000 ml of O2 by 100 g. of oil. In the Oxidator BN test, 0.8 ml of catalyst is used per 100 grams of oil and an additive package is included in the oil. The catalyst is a mixture of soluble metal naphthenates in kerosene. The mixture of soluble metal naphthenates simulates the average metal analysis of used crankcase oil. The level of metals in the catalyst is as follows: Copper=6,927 ppm; Iron=4,083 ppm; Lead=80,208 ppm; Manganese=350 ppm; Tin=3585 ppm. The additive package is 80 millimoles of zinc bispolypropylenephenyldithio-phosphate per 100 grams of oil, or approximately 1.1 grams of OLOA 260. The Oxidator BN test measures the response of a lubricating base oil in a simulated application. High values, or long times to absorb one liter of oxygen, indicate good oxidation stability.

OLOA is an acronym for Oronite Lubricating Oil Additive®, which is a registered trademark of Chevron Oronite.

Lubricant Base Oil Blend

When the light base oil fraction of this invention is blended with a heavier base oil fraction comprising a petroleum-derived API Group I base oil the lubricant base oil blend has a wt %. Noack volatility less than 29. In the context of this disclosure, a heavier base oil fraction is a base oil with a kinematic viscosity at 100° C. greater than 4.0 cSt.

In some embodiments the lubricant base oil blend has a CCS Viscosity at −35° C. less than 8,000 cP. CCS Viscosity is a test used to measure the viscometric properties of oils under low temperature and high shear. A low CCS Viscosity makes an oil very useful in a number of finished lubricants, including multigrade engine oils. The test method to determine CCS Viscosity is ASTM D 5293-04. Results are reported in centipoise, cP.

The lubricant base oil blend may have a kinematic viscosity at 100° C. between 3.0 and 7.0 cSt. In some embodiments, the lubricant base oil blend comprising a light base oil fraction and a heavier base oil fraction has a kinematic viscosity at 100° C. between 3.5 and 5.5 cSt. Lubricant base oil blends having a kinematic viscosity in this range are widely used in a broad range of finished lubricants.

The lubricant base oil blend of this invention will typically have a high viscosity index (VI). Generally it will have a VI greater than 90, preferably greater than 100, more preferably greater than 110. In some embodiments the lubricant base oil blend will have a VI less than 150, and in some embodiments it may have a VI less than 130.

In one embodiment, the lubricant base oil blend of this invention will have a T95-T5 boiling point range greater than 118° C. (212° F.). Boiling points are measured by simulated distillation by ASTM D6352-04 or an equivalent method. An equivalent test method refers to any analytical method which gives substantially the same results as the Standard method. T95 refers to the temperature at which 95 weight percent of the lubricant base oil blend has a lower boiling point. T5 refers to the temperature at which 5 weight percent of the lubricant base oil blend has a lower boiling point.

One example of a lubricant base oil blend of this invention comprises greater than 5 wt % (preferably about 10 to about 80 wt %), based upon the total blend, of the light base oil fraction characterized by a kinematic viscosity of about 1.5 to 3.6 at 100 degrees C. and a Noack volatility between 0 and 100 and additionally less than an amount defined by the equation:

$$\text{Noack Volatility Factor}=900\times(\text{Kinematic Viscosity at } 100^\circ\text{ C.})^{-2.8}-15.$$

Additionally, the one example of a lubricant base oil blend of this invention comprises less than 95 wt % (preferably from about 20 to about 90 wt %), based on the total blend, of petroleum-derived API Group I or Group II base oil.

The lubricant base oil blend of this invention may additionally comprise from about 0.01 to about 10 weight percent based on the total blend of a pour point depressant. The pour point depressant may be either a conventional pour point depressant additive or a pour point reducing blend component. Examples of conventional pour point depressant additives include polyalkylmethacrylates, styrene ester polymers, alkylated naphthalenes, ethylene vinyl acetate copolymers, and polyfumarates. Treat rates of conventional pour point depressant additives are typically less than 0.5 wt %. The pour point reducing blend component is a type of lubricating base oil made from a waxy feed. The pour point reducing blend component is an isomerized waxy product with relatively high molecular weights and particular branching properties such that it reduces the pour point of lubricating base oil blends containing them. The pour point depressing base oil blending component may be derived from either Fischer-Tropsch or petroleum products. In one embodiment the pour point reducing blend component is an isomerized petroleum-derived base oil having a boiling range above about 950 degrees F. (about 510 degrees C.) and contains at least 50 percent by weight of paraffins. Preferably the pour point depressing base oil blending component will have a boiling range above about 1050° F. (about 565 degrees C.). In a second embodiment, the pour point reducing blend component is an isomerized Fischer-Tropsch derived bottoms product having a pour point that at least 3 degrees C. higher than the pour point of the distillate base oil it is blended with. A preferred isomerized Fischer-Tropsch derived bottoms product that serves well as a pour point reducing blend component has an average molecular weight between about 600 and about 1100 and an average degree of branching in the molecules between about 6.5 and about 10 alkyl branches per 100 carbon atoms. The pour point reducing blend components are described in detail in U.S. Pat. No. 7,053,254, and Patent Application No. US20050247600, both fully incorporated herein.

The lubricant of this invention comprising the light lubricant base oil fraction and optionally one or more additives is especially suitable as an agricultural spray oil or grain dust suppressant. In some embodiments it will meet technical or medicinal white oil specifications and its low volatility will prevent it from contributing significantly to air pollution. An example of a method for making white oils using hydroisomerization dewaxing over a wax hydroisomerization catalyst having noble metal hydrogenation component and refractory oxide support is taught in US Patent Application US20060016724A1. Other methods for producing white oils include adsorbent treatment or highly effective hydroreprocessing. Agricultural or horticultural spray oils are used for example to spray on agricultural crops such as citrus to control scale, as dormant fruit tree sprays, and as fungicidal Phytopthera control agents on rubber. Grain dust suppressants are used to prevent dust explosions. They are applied as liquids, either with or without water.

Finished Lubricants:

Finished lubricants comprise a lubricant base oil and at least one additive. The lubricant base oil may be a lubricant base oil blend. Lubricant base oils are the most important component of finished lubricants, generally comprising greater than 70% of the finished lubricants. Finished lubricants may be used for example, in automobiles, diesel, engines, axles, transmissions, and industrial applications. Finished lubricants must meet the specifications for their intended application as defined by the concerned governing organization.

Additives which may be blended with the lubricant base oil blend or light base oil fraction of the present invention, to provide a finished lubricant composition, include those which are intended to improve select properties of the finished lubricant. Typical additives include, for example, pour point depressants, anti-wear additives, EP agents, detergents, dispersants, antioxidants, viscosity index improvers, viscosity modifiers, friction modifiers, demulsifiers, antifoaming agents, corrosion inhibitors; rust inhibitors, seal swell agents, emulsifiers, wetting agents, lubricity improvers, metal deactivators, gelling agents, tackiness agents, bactericides, fungicides, fluid-loss additives, colorants, and the like.

Typically, the total amount of additives in the finished lubricant will be approximately 0.1 to about 30 weight percent of the finished lubricant. However, since the lubricating base oils of the present invention have excellent properties including excellent oxidation stability, low wear, high viscosity index, low volatility, good low temperature properties, good additive solubility, and good elastomer compatibility, a lower amount of additives may be required to meet the specifications for the finished lubricant than is typically required with base oils made by other processes. The use of additives in formulating finished lubricants is well documented in the literature and well known to those of skill in the art.

Waxy Feed

Suitable waxy feeds have high levels of n-paraffins and are low in oxygen, nitrogen, sulfur, and elements such as aluminum, cobalt, titanium, iron, molybdenum, sodium, zinc, tin, and silicon. The waxy feeds useful in this invention have greater than 40 weight percent n-paraffins, less than 1 weight percent oxygen, less than 25 ppm total combined nitrogen and sulfur, and less than 25 ppm total combined aluminum, cobalt, titanium, iron, molybdenum, sodium, zinc, tin, and silicon. In some embodiments, the waxy feeds have greater than 50 weight percent n-paraffins, less than 0.8 weight percent oxygen, less than 20 ppm total combined nitrogen and sulfur, and less than 20 ppm total combined aluminum, cobalt, titanium, iron, molybdenum, sodium, zinc, tin, and silicon. In other embodiments, the waxy-feeds have greater than 75 weight percent n-paraffins, less than 0.8 weight percent oxygen, less than 20 ppm total combined nitrogen and sulfur, and less than 20 ppm total combined aluminum, cobalt, titanium, iron, molybdenum, sodium, zinc, tin, and silicon.

Waxy feeds useful in this invention are expected to be plentiful and relatively cost competitive in the near future as large-scale Fischer-Tropsch synthesis processes come into production. The Fischer-Tropsch synthesis process provides a way to convert a variety of hydrocarbonaceous resources into products usually provided by petroleum. In preparing hydrocarbons via the Fischer-Tropsch process, a hydrocarbonaceous resource, such as, for example, natural gas, coal, refinery fuel gas, tar sands, oil shale, municipal waste, agricultural waste, forestry waste, wood, shale oil, bitumen, crude oil, and fractions from crude oil, is first converted into synthesis gas which is a mixture comprising carbon monoxide and hydrogen. The synthesis gas is further processed into syncrude. Syncrude prepared from the Fischer-Tropsch process comprises a mixture of various solid, liquid, and gaseous hydrocarbons. Those Fischer-Tropsch products which boil within the range of lubricating base oil contain a high proportion of wax which makes them ideal candidates for processing into base oil. Accordingly, Fischer-Tropsch wax represents an excellent feed for preparing high quality base oils according to the process of the invention. Fischer-Tropsch wax is normally solid at room temperature and, consequently, displays poor low temperature properties, such as pour point and cloud point. However, following hydroisomerization of the wax, Fischer-Tropsch derived base oils having excellent low temperature properties may be prepared.

The terms "Fischer-Tropsch derived" or "FT derived" means that the product, fraction, or feed originates from or is produced at some stage by a Fischer-Tropsch process. The feedstock for the Fischer-Tropsch process may come from a wide variety of hydrocarbonaceous resources, including biomass, natural gas, coal, shale oil, petroleum, municipal waste, derivatives of these, and combinations thereof.

Hydroisomerization Dewaxing

The hydroisomerization dewaxing is achieved by contacting the waxy feed with a hydroisomerization catalyst in an isomerization zone under hydroisomerizing conditions. The hydroisomerization catalyst preferably comprises a shape selective intermediate pore size molecular sieve, a noble metal hydrogenation component, and a refractory oxide support. The shape selective intermediate pore size molecular sieve is preferably selected from the group consisting of SAPO-11, SAPO-31, SAPO-41, SM-3, ZSM-22, ZSM-23, ZSM-35, ZSM-48, ZSM-57, SSZ-32, offretite, ferrierite, and combinations thereof. SAPO-11, SM-3, SSZ-32, ZSM-23, and combinations thereof are often used. The noble metal hydrogenation component can be platinum, palladium, or combinations thereof.

The hydroisomerizing conditions depend on the waxy feed used, the hydroisomerization catalyst used, whether or hot the catalyst is sulfided, the desired yield, and the desired properties of the base oil. Preferred hydroisomerizing conditions useful in the current invention include temperatures of 260 degrees C. to about 413 degrees C. (500 to about 775 degrees F.), a total pressure of 15 to 3000 psig, a LHSV of 0.25 to 20 $Hr^{-1}$, and a hydrogen to feed ratio from about 2 to 30 MSCF/bbl. In some embodiments the hydrogen to feed ratio can be from about 4 to 20 MSCF/bbl, in others from about 4.5 to about 10 MSCF/bbl, and in still others from about 5 to about 8 MSCF/bbl. Generally, hydrogen will be separated from the product and recycled to the isomerization zone. Note that a feed rate of 10 MSCF/bbl is equivalent to 1781, liter H2/liter feed. Generally, hydrogen will be separated from the product and recycled to the isomerization zone.

In some embodiments the hydroisomerization dewaxing is conducted in a series of reactors for optimal yield and base oil properties. A series of hydroisomerization reactors with inter-reactor separation may achieve the same pour point reduction, at lower temperatures and lower catalyst aging rates, as a single reactor without product separation and recycle or multiple reactors without inter-reactor separation. Therefore, multiple reactors with inter-reactor separation may operate longer within the desired ranges of temperature, space velocity and catalyst activity than a single reactor or multiple reactors without inter-reactor separation.

Additional details of suitable hydroisomerization dewaxing processes are described in U.S. Pat. Nos. 5,135,638 and 5,282,958; and US Patent Application 20050133409, which are incorporated herein by reference.

Hydrofinishing

Optionally, the base oil produced by hydroisomerization dewaxing may be hydrofinished. The hydrofinishing may occur in one or more steps, either before or after fractionating of the base oil into one or more fractions. The hydrofinishing is intended to improve the oxidation stability, UV stability, and appearance of the product by removing aromatics, olefins, color bodies, and solvents. A general description of hydrofinishing may be found in U.S. Pat. Nos. 3,852,207 and 4,673,487, which are incorporated herein by reference. The hydrofinishing step may be needed to reduce the weight percent olefins in the base oil to less than 10, preferably less than 5 or 2, more preferably less than 1, even more preferably less than 0.5, and most preferably less than 0.05 or 0.01. The hydrofinishing step may also be needed to reduce the weight percent aromatics to less than 0.3 or 0.1, preferably less than 0.05, more preferably less than 0.2, and most preferably less than 0.01.

Preferably the hydrofinishing is conducted at a total pressure greater than 500 psig, more preferably greater than 700 psig, most preferably greater than 850 psig. In some embodiments the hydrofinishing may be conducted in a series of reactors to produce base oils with superior oxidation stability and low wt % Noack volatility. As with hydroisomerization dewaxing, hydrofinishing in multiple reactors with inter-reactor separation may operate longer within the desired ranges of temperature, space velocity and catalyst activity than a single reactor or multiple reactors without inter-reactor separation.

Fractionating

Lubricating base oil is typically separated into fractions, whereby one or more light base oil fractions are produced having a pour point less than 0° C., preferably less than −20° C., more preferably less than −30° C. The base oil, if broad boiling, may be fractionated into different viscosity grades of base oil. In the context of this disclosure "different viscosity grades of base oil" is defined as two or more base oils differing in kinematic viscosity at 100 degrees C. from each other by at least 1.0 cSt. Preferably, fractionating is done using one or more vacuum distillation units to yield cuts with pre selected boiling ranges.

Specific Analytical Test Methods for Characterizing Base Oils:

Wt % Olefins:

The Wt % Olefins in the light base oil fraction of this invention is determined by proton-NMR by the following steps, A-D:

A. Prepare a solution of 5-10% of the test hydrocarbon In deuterochloroform.

B. Acquire a normal proton spectrum of at least 12 ppm spectral width and accurately reference the chemical shift (ppm) axis. The instrument must have sufficient gain range to acquire a signal without overloading the receiver/ADC. When a 30 degree pulse is applied, the instrument must have a minimum signal digitization dynamic range of 65,000. Preferably the dynamic range will be 260,000 or more.

C. Measure the integral intensities between:

6.0−4.5 ppm (olefin)

2.2−19 ppm (allylic)

1.9−0.5 ppm (saturate)

D. Using the molecular weight of the test substance determined by ASTM D 2503, calculate:

1. The average molecular formula of the saturated hydrocarbons
2. The average molecular formula of the olefins
3. The total integral intensity (=sum of all integral intensities)
4. The integral intensity per sample hydrogen (=total integral/number of hydrogens in formula)
5. The number of olefin hydrogens (=olefin integral/integral per hydrogen)
6. The number of double bonds (=olefin hydrogen times hydrogens in olefin formula/2)
7. The wt % olefins by proton NMR=100 times the number of double bonds times the number of hydrogens in a typical olefin molecule divided by the number of hydrogens in a typical test substance molecule.

The wt % olefins by proton NMR calculation procedure, D, works best when the % Olefins result is low, less than about 15 weight percent. The olefins must be "conventional" olefins; i.e. a distributed mixture of those olefin types having hydrogens attached to the double bond carbons such as: alpha, vinylidene, cis, trans, and trisubstituted. These olefin types will have a detectable allylic to olefin integral ratio between 1 and about 2.5. When this ratio exceeds about 3, it indicates a higher percentage of tri or tetra substituted olefins are present and that different assumptions must be made to calculate the number of double bonds in the sample.

Aromatics Measurement by HPLC-UV:

The method used to measure low levels of molecules with at least one aromatic function in the light base oil fractions of this invention uses a Hewlett Packard 1050 Series Quaternary Gradient High Performance Liquid Chromatography (HPLC) system coupled with a HP 1050 Diode-Array UV-Vis detector interfaced to an HP Chem-station. Identification of the individual aromatic classes in the highly saturated base oils was made on the basis of their UV spectral pattern and their elution time. The amino column used for this analysis differentiates aromatic molecules largely on the basis of their ring-number (or more correctly, double-bond number). Thus, the single ring aromatic containing molecules elute first, followed by the polycyclic aromatics in order of increasing double bond number per molecule. For aromatics with similar double bond character, those with only alkyl substitution on the ring elute sooner than those with naphthenic substitution.

Unequivocal identification of the various base oil aromatic hydrocarbons from their UV absorbance spectra was accomplished recognizing that their peak electronic transitions were all red-shifted relative to the pure model compound analogs to a degree dependent on the amount of alkyl and naphthenic substitution on the ring system. These bathochromic shifts are well known to be caused by alkyl-group delocalization of the π-electrons in the aromatic ring. Since few unsubstituted aromatic compounds boil in the lubricant range, some degree of red-shift was expected and observed for all of the principle aromatic groups identified.

Quantitation of the eluting aromatic compounds was made by integrating chromatograms made from wavelengths optimized for each general class of compounds over the appropriate retention time window for that aromatic. Retention time window limits for each aromatic class were determined by manually evaluating the individual absorbance spectra of eluting compounds at different times and assigning them to the appropriate aromatic class based on their qualitative similarity to model compound absorption spectra. With few exceptions, only five classes of aromatic compounds were observed in highly saturated API Group II and III lubricant base oils.

HPLC-UV Calibration:

HPLC-UV is used for identifying these classes of aromatic compounds even at very low levels. Multi-ring aromatics typically absorb 10 to 200 times more strongly than single-ring aromatics. Alkyl-substitution also affected absorption by about 20%. Therefore, it is important to use HPLC to separate and identify the various species of aromatics and know how efficiently they absorb.

Five classes of aromatic compounds were identified. With the exception of a small overlap between the most highly retained alkyl-1-ring aromatic naphthenes and the least highly retained alkyl naphthalenes, all of the aromatic compound classes were baseline resolved. Integration limits for the co-eluting 1-ring and 2-ring aromatics at 272 nm were made by the perpendicular drop method. Wavelength dependent response factors for each general aromatic class were first determined by constructing Beer's Law plots from pure model compound mixtures based on the nearest spectral peak absorbances to the substituted aromatic analogs.

For example, alkyl-cyclohexylbenzene molecules in base oils exhibit a distinct peak absorbance at 272 nm that corresponds to the same (forbidden) transition that unsubstituted tetralin model compounds do at 268 nm. The concentration of alkyl-1-ring aromatic naphthenes in base oil samples was calculated by assuming that its molar absorptivity response factor at 272 nm was approximately equal to tetralin's molar absorptivity at 268 nm, calculated from Beer's law plots. Weight percent concentrations of aromatics were calculated by assuming that the average molecular weight for each aromatic class was approximately equal to the average molecular weight for the whole base oil sample.

This calibration method was further improved by isolating the 1-ring aromatics directly from the lubricant base oils via exhaustive HPLC chromatography. Calibrating directly with these aromatics eliminated the assumptions and uncertainties associated with the model compounds. As expected, the isolated aromatic sample had a lower response factor than the model compound because it was more highly substituted.

More specifically, to accurately calibrate the HPLC-UV method, the substituted benzene aromatics were separated from the bulk of the lubricant base oil using a Waters semi-preparative HPLC unit. 10 grams of sample was diluted 1:1 in n-hexane and injected onto an amino-bonded silica column, a 5 cm×22.4 mm ID guard, followed by two 25 cm×22.4 mm ID columns of 8-12 micron amino-bonded silica particles, manufactured by Rainin Instruments, Emeryville, Calif., with n-hexane as the mobile phase at a flow rate of 18 mls/min. Column eluent was fractionated based on the detector response from a dual wavelength UV detector set at 265 nm and 295 nm. Saturate fractions were collected until the 265 nm absorbance showed a change of 0.01 absorbance units, which signaled the onset of single ring aromatic elution. A single ring aromatic fraction was collected until the absorbance ratio between 265 nm and 295 nm decreased to 2.0, indicating the onset of two ring aromatic elution. Purification and separation of the single ring aromatic fraction was made by re-chromatographing the monoaromatic fraction away from the "tailing" saturates fraction which resulted from overloading the HPLC column.

This purified aromatic "standard" showed that alkyl substitution decreased the molar absorptivity response factor by about 20% relative to unsubstituted tetralin.

Confirmation of Aromatics by NMR:

The weight percent of all molecules with at least one aromatic function in the purified mono-aromatic standard was confirmed via long-duration carbon 13 NMR analysis. NMR was easier to calibrate than HPLC UV because it simply measured aromatic carbon so the response did not depend on the class of aromatics being analyzed. The NMR results were translated from % aromatic carbon to % aromatic molecules (to be consistent with HPLC-UV and D 2007) by knowing that 95-99% of the aromatics in highly saturated lubricant base oils were single-ring aromatics.

High power, long duration, and good baseline analysis were needed to accurately measure aromatics down to 0.2% aromatic molecules.

More specifically, to accurately measure low levels of all molecules with at least one aromatic function by NMR, the standard D 5292-99 method was modified to give a minimum carbon sensitivity of 500:1 (by ASTM standard practice E 386). A 15-hour duration run on a 400-500 MHz NMR with a 10-12 mm Nalorac probe was used. Acorn PC integration software was used to define the shape of the baseline and consistently integrate. The carrier frequency was changed once during the run to avoid artifacts from imaging the aliphatic peak into the aromatic region. By taking spectra on either side of the carrier spectra, the resolution was improved significantly.

Specific Analytical Test Methods for Characterizing Waxy Feeds

Nitrogen content in the waxy feed is measured by melting the waxy feed prior to oxidative combustion and chemiluminescence detection by ASTM D 4629-02. The sulfur is measured by melting the waxy feed prior to ultraviolet fluorescence by ASTM D 5453-06. The test methods for measuring nitrogen and sulfur are further described in U.S. Pat. No. 6,503,956.

Oxygen content in the waxy feed is measured by neutron activation. The technique used to do the elemental analysis for aluminum, cobalt, titanium, iron, molybdenum, sodium, zinc, tin, and silicon is inductively coupled plasma atomic emission spectroscopy (ICP-AES). In this technique, the sample is placed in a quartz vessel (ultrapure grade) to which is added sulfuric acid, and the sample is then ashed in a programmable muffle furnace for 3 days. The ashed sample is then digested with HCl to convert it to an aqueous solution prior to ICP-AES analysis. The oil content of the more preferred waxy feeds is less than 10 weight percent as determined by ASTM D721-05.

Weight Percent Normal Paraffins:

Determination of normal paraffins (n-paraffins) in wax-containing samples should use a method that can determine the content of individual C7 to C110 n-paraffins with a limit of detection of 0.1 wt %. The preferred method used is as follows.

Quantitative analysis of normal paraffins in waxy feed is determined by gas chromatography (GC). The GC (Agilent 6890 or 5890 with capillary split/splitless inlet and flame ionization detector) is equipped with a flame ionization detector, which is highly sensitive to hydrocarbons. The method utilizes a methyl silicone capillary column, routinely used to separate hydrocarbon mixtures by boiling point. The column is fused silica, 100% methyl silicone, 30 meters length, 0.25 mm ID, 0.1 micron film thickness supplied by Agilent. Helium is the carrier gas (2 ml/min) and hydrogen and air are used as the fuel to the flame.

The waxy feed is melted to obtain a 0.1 g homogeneous sample. The sample is immediately dissolved in carbon disulfide to give a 2 wt % solution. If necessary, the solution is heated until visually clear and free of solids, and then injected into the GC. The methyl silicone column is heated using the following temperature program:

Initial temp: 150° C. (If C7 to C15 hydrocarbons are present, the initial temperature is 50° C.)

Ramp: 6° C. per minute

Final Temp: 400° C.

Final hold: 5 minutes or until peaks no longer elute

The column then effectively separates, in the order of rising carbon number, the normal paraffins from the non-normal paraffins. A known reference standard is analyzed in the same manner to establish elution times of the specific normal-paraffin peaks. The standard is ASTM D2887 n-paraffin standard, purchased from a vendor (Agilent or Supelco), spiked with 5 wt % Polywax 500 polyethylene (purchased from Petrolite Corporation in Oklahoma). The standard is melted prior to injection. Historical data collected from the analysis of the reference standard also guarantees the resolving efficiency of the capillary column.

If present in the sample, normal paraffin peaks are well separated and easily identifiable from other hydrocarbon types present in the sample. Those peaks eluting outside the retention time of the normal paraffins are called non-normal paraffins. The total sample is integrated using baseline hold from start to end of run. N-paraffins are skimmed from the total area and are integrated from valley to valley. All peaks detected are normalized to 100%. EZChrom is used for the peak identification and calculation of results.

EXAMPLES

Example 1

Samples of ExxonMobil Americas CORE 150 base oil, ExxonMobil 100SN and ExxonMobil 330SN base oils had properties as shown in Table I

TABLE I

| | ExxonMobil CORE 150 | ExxonMobil 100SN | ExxonMobil 330SN |
|---|---|---|---|
| Property | | | |
| Kin Vis @ 40° C., cSt | 30.51 | 20.17 | 64.32 |
| Kin Vis @ 100° C., cSt | 5.248 | 4.032 | 8.299 |
| VI | 102 | 94 | 97 |
| Noack, Wt % | 17.84* | 26.3 | 7.63 |

TABLE I-continued

| | ExxonMobil CORE 150 | ExxonMobil 100SN | ExxonMobil 330SN |
|---|---|---|---|
| CCS @ −25° C., cPs | | | 16,662 |
| CCS @ −35° C., cPs | 12,950 | 6311 | |
| Brookfield Vis @ −40° C., cP | | 27,050 (with 0.4% Viscoplex 1-300) | |
| D 6352 SIMDIST TBP | | | |
| (WT %), ° F. 5 | 682 | 650 | 714 |
| 10/30 | 702/756 | 675/722 | 760/840 |
| 50 | 802 | 760 | 878 |
| 70/90 | 844/893 | 798/843 | 913/963 |
| 95 | 912 | 862 | 982 |

*Converted from the results obtained by ASTM D5800A.

Example 2

Three samples of Fischer-Tropsch derived base oil were analyzed and determined to have the following properties:

TABLE II

| | FT-A | FT-B | FT-C |
|---|---|---|---|
| Properties | | | |
| Kin. Vis @ 40° C., cSt | 10.00 | 10.85 | 11.76 |
| Kin Vis @ 100° C., cSt | 2.806 | 2.926 | 3.081 |
| VI | 130 | 124 | 124 |
| Pour Point, ° C. | −40 | −37 | −43 |
| Noack, Wt % | 34.32 | 32.37 | 27.23 |
| CCS Vis @ −40° C., cP | <900 | 1238 | 1398 |
| D 6352 SIMDIST TBP (WT %), ° F. | | | |
| 0.5/5 | 655/672 | 665/683 | 677/695 |
| 10/30 | 681/705 | 692/717 | 704/727 |
| 50 | 727 | 737 | 747 |
| 70/90 | 747/772 | 755/777 | 765/787 |
| 95 | 782 | 785 | 795 |
| Wt % Aromatics | 0.0063 | 0.0131 | 0.0043 |
| Wt % Olefins | <0.1 | <0.1 | <0.1 |
| Oxidator BN, Hours | 59.56 | 40.16 | 39.09 |
| NVF = 900 × $(KV100)^{-2.8}$ − 15 | 35.07 | 29.53 | 23.54 |

The three Fischer-Tropsch derived base oils were all distillate fractions made by hydroisomerization dewaxing a hydrotreated Co-based Fischer-Tropsch wax in a series of two reactors, hydrofinishing the effluent in a single reactor, and vacuum distilling the product into different grades of base oil. All three of these Fischer-Tropsch derived base oils had very low aromatics and olefin contents, and had very good oxidation stabilities. Additionally, all three of them had very low Noack volatilities. Note that only the FT-A had a wt % Noack Volatility less than an amount defined by the equation: Noack Volatility Factor=900×(Kinematic Viscosity at 100° C.)$^{-2.8}$−15. The difference between the wt % Noack volatility of the fight base oil fraction FT-A and the Noack Volatility Factor of FT-A was greater than 0.5. FT-A also had extremely good oxidation stability and a viscosity index greater than 28×Ln (Kinematic Viscosity at 100° C.)+95.

Example 3

Four different blends of Fischer-Tropsch derived base oil with ExxonMobil 330SN base oil were prepared. The weight percent formulations and properties of these blends (Blend A, Blend B, Blend C and Blend D), compared with a comparison blend of ExxonMobil 100SN with ExxonMobil Americas CORE 150 (Blend E), and neat ExxonMobil Americas CORE 150 are summarized below in Table III.

TABLE III

| | Blend A | Comp. Blend B | Blend C | Comp. Blend D | Comp. Blend E | Exxon CORE 150 |
|---|---|---|---|---|---|---|
| Blend Formulations | | | | | | |
| FT-A, 34 Noack | 50% | 0% | 70% | 0% | 0% | 0% |
| FT-C, 27 Noack | 0% | 50% | 0% | 70% | 0% | 0% |
| ExxonMobil 330SN | 50% | 50% | 30% | 30% | 0% | 0% |
| ExxonMobil 100SN | | | | | 67% | 0% |
| ExxonMobil Americas CORE 150 | | | | | 33% | 100% |
| Blend Properties | | | | | | |
| KV at 40° C., cSt | 21.00 | 24.33 | 15.23 | 17.71 | 23.54 | 30.51 |
| KV at 100° C., cSt | 4.288 | 4.658 | 3.588 | 3.871 | 4.354 | 5.248 |
| VI | 110 | 108 | 119 | 111 | 86 | 102 |
| Pour Pt., ° C. | −14 | −16 | −19 | −21 | −17 | −15 |
| Noack, D5800, wt. % | 22.02 | 16.66 | 28.31 | 21.08 | 25.00 | 17.84* |
| CCS @ −35° C., cP | 3354 | 4501 | 1521 | 2009 | 8050 | 12950 |
| D6352-04 - Sim Dist. wt % | | | | | | |
| 0.5/5 | 614/676 | 648/697 | 652/674 | 663/696 | 566/661 | 635/683 |
| 10/30 | 689/728 | 709/745 | 684/716 | 707/737 | 684/732 | 702/756 |
| 50 | 768 | 780 | 745 | 762 | 773 | 802 |
| 70/90 | 858/931 | 859/935 | 783/911 | 794/909 | 814/865 | 845/894 |
| 95/99.5 | 960/1009 | 966/1034 | 950/1029 | 946/1026 | 888/952 | 914/998 |
| Brookfield Vis @ −40° C. w/ PMA @ 0.4% PPD treat rate | 8,080 | 12,460 | 3,150 | 4,280 | 42,900 | 308,400 |
| T95-T5 Boiling Point Range | 284 | 269 | 276 | 250 | 227 | 231 |

*Converted from the results obtained by ASTM D5800A.

All of the blends made with a light Fischer-Tropsch derived base oil fraction had lower Noack volatility and CCS viscosity that the comparison blend E with no Fischer-Tropsch derived light base oil fraction. Blend A and Blend C are examples of the base oil blends of this invention. Both Blend A and Blend C had Noack volatilities less than 29 wt %. Surprisingly both Blend A and Blend C had T95-T5 boiling point ranges greater than 212° F. (118° C.). Additionally, when they were blended, with 0.4 wt % polymethacrylate (PMA) pour point depressant they gave significantly lower Brookfield viscosities at −40° C. than expected. Surprisingly, the blends made with the Fischer-Tropsch derived base oil having the lower Noack volatility (Comp. Blend B and Comp. Blend D) did not produce base oil blends with as low a wt % Noack volatility as the blends of this invention.

The pour point depressed lubricant base oil blends as shown in Table III, when blended with one or more additional additives would make excellent finished lubricants, including multigrade engine oils, automatic transmission fluids, and a full range of industrial oils and greases. Examples of multigrade engine oils are passenger car motor oil, heavy duty motor oil, natural gas engine oil, and medium speed engine oil.

Example 4

Hydrotreated Co-based Fischer-Tropsch wax was hydroisomerized over a Pt/SAPO-11 hydroisomerization catalyst in a series of three reactors at a temperature of 600-700 degrees F., about 1 LHSV feed rate, less than 800 psig pressure, and about 4 to about 20 MSCF/bbl hydrogen flow rate. Following hydroisomerization, the product was hydrofinished over a Pd/Silica Alumina hydrofinishing catalyst in a series of two hydrofinishing reactors at a total pressure greater than 700 psig, a temperature of about 400 to about 600 degrees F., about 1 LHSV feed rate, and about 4 to about 20 MSCF/bbl hydrogen flow rate.

The products out of the hydrofinishing reactor were vacuum distilled into different base oil grades, one or more fractions having a kinematic viscosity at 100° C. between 1.5 and 3.5 cSt. Two of these base oil fractions were analyzed and determined to have the following properties:

TABLE IV

| | FT-D | FT-E |
|---|---|---|
| Properties | | |
| Kin Vis @ 100° C., cSt | 1.768 | 2.919 |
| VI | | 126 |
| Pour Point, ° C. | −57 | −31 |
| Noack, Wt % | 82.13 | 22.5 |
| D6352 SIMDIST TBP (WT %), ° F. | | |
| 0.5/5 | 148/443 | 672/693 |
| 10/30 | 546/615 | 702/721 |
| 50 | 645 | 737 |
| 70/90 | 669/693 | 754/777 |
| 95 | 702 | 788 |
| Wt % Aromatics | 0.0174 | <0.005 |
| Wt % Olefins | <0.1 | 0.11 |
| Oxidator BN, Hours | 49.92 | 64.04 |
| NVF = 900 × (KV100)$^{-2.8}$ − 15 | 167.5 | 29.8 |

Both of these base oils had a wt % Noack volatility between 0 and 100 and additionally less than an amount defined by the equation: Noack Volatility Factor=900×(Kinematic Viscosity at 100° C.)$^{-2.8}$−15. The difference between the wt % Noack volatilities of the light base oil fractions FT-D and FT-E and their Noack Volatility Factors were greater than 5. They both had exceptionally good oxidation stabilities, low pour points, and high VIs. These oils would be especially useful either alone or in blends with other conventional API Group I and Group II base oils to make high quality finished lubricants, or used as diluent oil in additive concentrates. The use of preferred light base oil fractions made from waxy feeds as diluents for additives is taught in US Patent Applications US20080201852 and US20060205810.

All of the publications, patents and patent applications cited in this application are herein incorporated by reference in their entirety to the same extent as if the disclosure of each individual publication, patent application or patent was specifically and individually indicated to be incorporated by reference in its entirety.

Many modifications of the exemplary embodiments of the invention disclosed above will readily occur to those skilled in the art. Accordingly, the invention is to be construed as including all structure and methods that fall within the scope of the appended claims.

What is claimed is:

1. A process for making a lubricant base oil blend, comprising:

hydroisomerization dewaxing a waxy feed in a series of hydroisomerization reactors to make a light base oil fraction having:

i. a kinematic viscosity at 100° C. between 1.5 and 3.6 cSt;

ii. a pour point of −40° C. or less; and iii. a wt % Noack volatility between 0 and 100 and additionally less than a Noack Volatility Factor, wherein the Noack Volatility Factor is defined by the equation:

$$900\times(\text{Kinematic Viscosity at } 100^\circ \text{ C., in cSt})^{2.8}-15;$$

and blending together said light base oil fraction with a heavier base oil fraction comprising a petroleum-derived base oil; wherein the lubricant base oil blend has a wt % Noack volatility less than or equal to 29 and a VI less than 120.

2. The process of claim 1, wherein the difference between the wt % Noack volatility of the light base oil fraction and the Noack Volatility factor is greater than 0.5.

3. The process of claim 1, wherein the petroleum-derived base oil is API Group I or Group II.

4. The process of claim 3, wherein the petroleum-derived base oil is API Group I.

5. The process of claim 1, wherein the lubricant base oil blend additionally has a CCS Viscosity at −35° C. less than 8,000 cP.

6. The process of claim 1, wherein the lubricant base oil blend has a kinematic viscosity at 100° C. between 3.5 and 5.5 cSt.

7. The process of claim 1, wherein the lubricant base oil blend has a VI greater than 100.

8. The process of claim 1, wherein the lubricant base oil blend has a T95-T5 boiling point range greater than 118° C.

9. The process of claim 1, wherein the light base oil fraction is made from a waxy feed.

10. The process of claim 9, wherein the waxy feed is Fischer-Tropsch derived.

11. The process of claim 1, additionally comprising blending the lubricant base oil blend with a pour point depressant to make a pour point depressed lubricant base oil blend having a Brookfield viscosity at −40° C. of less than 18,000 cP.

12. The process of claim 1, wherein the lubricant base oil blend is a diluent oil for use in an additive concentrate.

13. The process of claim 1, additionally comprising adding at least one additive to the lubricating base oil blend to make a finished lubricant.

14. The process of claim 13, wherein the finished lubricant is selected from the group consisting of engine oil, automatic transmission fluid, industrial oil, and grease.

15. The process of claim 1, wherein the lubricant base oil blend has a wt % Noack volatility less than or equal to 25.

16. A lubricant base oil blend, comprising:

a. a light base oil fraction characterized by a kinematic viscosity of about 1.5 to 3.6 cSt at 100 degrees C., a pour point of −40° C. or less, and a wt % Noack volatility between 0 and 100 and additionally less than a Noack Volatility Factor, wherein the Noack Volatility Factor is defined by the equation:

$$900\times(\text{Kinematic Viscosity at } 100^\circ \text{ C., in cSt})^{2.8}-15,$$

and which is made by hydroisomerization dewaxing a waxy feed in a series of hydroisomerization reactors; and b. a petroleum-derived base oil fraction; wherein the lubricant base oil blend has a wt % Noack volatility less than or equal to 29 and a VI less than 120.

17. The lubricant base oil blend of claim 16, wherein the difference between the wt % Noack volatility of the light base oil fraction and the Noack Volatility factor is greater than 0.5.

18. The lubricant base oil blend of claim 16, wherein the light base oil fraction is from about 10 to about 80 wt % based upon the total blend.

19. The lubricant base oil blend of claim 16, wherein the petroleum-derived base oil fraction is from about 20 to about 90 wt % based on the total blend.

20. The lubricant base oil blend of claim 16, wherein the petroleum-derived base oil is API Group I or Group II.

21. The lubricant base oil blend of claim 20, wherein the petroleum-derived base oil is API Group I.

22. The lubricant base oil blend of claim 16, wherein the lubricant base oil blend is an API Group I.

23. The lubricant base oil blend of claim 16, additionally having a CCS Viscosity at −35° C. less than 8,000 cP.

24. The lubricant base oil blend of claim 16, additionally having a VI greater than 100.

25. The lubricant base oil blend of claim 16, wherein the light base oil fraction is made from a waxy feed.

26. The lubricant base oil blend of claim 25, wherein the waxy feed is Fischer-Tropsch derived.

27. The lubricant base oil blend of claim 26, wherein the Fischer-Tropsch derived waxy feed is produced from a hydrocarbonaceous resource selected from biomass, natural gas, coal, shale oil, petroleum, municipal waste, derivatives of these, and combinations thereof.

28. The lubricant base oil blend of claim 16, additionally having a kinematic viscosity at 100° C. between 3.5 and 5.5 cSt.

29. The lubricant base oil blend of claim 16, additionally comprising from about 0.01 to about 10 weight percent based on the total blend of a pour point depressant.

30. The lubricant base oil blend of claim 16, wherein the lubricant base oil blend has a wt % Noack volatility less than or equal to 25.

31. A pour point depressed lubricant base oil blend, comprising:

a. a light base oil fraction characterized by a kinematic viscosity of about 1.5 to 3.6 cSt at 100 degrees C., a pour point of −40° C. or less, and a wt % Noack volatility between 0 and 100 and additionally less than a Noack Volatility Factor, wherein the Noack Volatility Factor is defined by the equation:

$$900\times(\text{Kinematic Viscosity at } 100^\circ \text{ C., in cSt})^{2.8}-15,$$

which is made by hydroisomerization dewaxing a waxy feed in a series of hydroisomerization reactors;

b. a petroleum-derived base oil fraction; and c. a pour point depressant; wherein the pour point depressed lubricant base oil blend has a Brookfield viscosity at −40° C. of less than 18,000 cP and a VI less than 120.

32. The pour point depressed lubricant base oil blend of claim 31, wherein the difference between the wt % Noack volatility of the light base oil fraction and the Noack Volatility Factor is greater than 0.5.

33. The pour point depressed lubricant base oil blend of claim 31, wherein the light base oil fraction is from about 10 to about 80 wt % based upon the total blend.

34. The pour point depressed lubricant base oil blend of claim 31, wherein the petroleum-derived base oil fraction is from about 20 to about 90 wt % based upon the total blend.

35. The pour point depressed lubricant base oil blend of claim 31, wherein the pour point depressant is from about 0.01 to about 10 wt % based on the total blend.

36. The pour point depressed lubricant base oil blend of claim 31, wherein the petroleum-derived base oil is API Group I or Group II.

37. The pour point depressed lubricant base oil blend of claim 36, wherein the petroleum-derived base oil is API Group I.

38. The pour point depressed lubricant base oil blend of claim 31, wherein the light base oil fraction is a Fischer-Tropsch derived distillate fraction.

39. The pour point depressed lubricant base oil blend of claim 31, additionally comprising from about 0.05 to 30 wt % based on the total blend of one or more additional additives.

40. The pour point depressed lubricant base oil blend of claim 31, wherein the pour point depressed lubricant base oil blend is an engine oil, an automatic transmission fluid, an industrial oil, or a grease.

41. The pour point depressed lubricant base oil blend of claim 31, wherein the pour point depressed lubricant base oil blend has a wt % Noack volatility less than or equal to 29.

42. The process of claim 1, wherein the wt % Noack volatility of the light base oil fraction is from 34.32 to 100.

43. The lubricant base oil blend of claim 16, wherein the wt % Noack volatility of the light base oil fraction is from 34.32 to 100.

44. The pour point depressed lubricant base oil blend of claim 31, wherein the wt % Noack volatility of the light base oil fraction is from 34.32 to 100.

45. The process of claim 1, wherein the kinematic viscosity at 100° C. is between 1.5 and 1.769 cSt.

46. The lubricant base oil blend of claim 16, wherein the kinematic viscosity at 100 degrees C. is between 1.5 and 1.769 cSt.

47. The pour point depressed lubricant base oil blend of claim 31, wherein the kinematic viscosity at 100 degrees C. is between 1.5 and 1.769 cSt.

* * * * *